US009237395B2

(12) United States Patent
Sze et al.

(10) Patent No.: US 9,237,395 B2
(45) Date of Patent: Jan. 12, 2016

(54) MODULAR AUDIO SYSTEMS AND RELATED ASSEMBLIES AND METHODS

(75) Inventors: Kevin Sze, Salt Lake City, UT (US); Zack Leader, Park City, UT (US); Jon Lee Anderson, Park City, UT (US); Peter M. Kelly, Park City, UT (US); Tetsuro Oishi, Park City, UT (US); Thomas C. Burton, Sandy, UT (US)

(73) Assignee: Skullcandy, Inc., Park City, UT (US)

( * ) Notice: Subject to any disclaimer, the term of this patent is extended or adjusted under 35 U.S.C. 154(b) by 517 days.

(21) Appl. No.: 13/451,299

(22) Filed: Apr. 19, 2012

(65) Prior Publication Data

US 2013/0177195 A1 Jul. 11, 2013

Related U.S. Application Data

(60) Provisional application No. 61/584,664, filed on Jan. 9, 2012.

(51) Int. Cl.
*H04R 25/00* (2006.01)
*H04R 1/02* (2006.01)
(Continued)

(52) U.S. Cl.
CPC ..... *H04R 1/1033* (2013.01); *H04R 1/026* (2013.01); *H04R 1/10* (2013.01); *H04R 1/105* (2013.01);
(Continued)

(58) Field of Classification Search
CPC .. H04R 1/105; H04R 5/0335; H04R 2201/10; H04R 1/10; H04R 2205/033; H04R 1/026; H04R 1/1033; H04R 1/021; H04R 1/028; H04R 1/1041; H04R 1/1075; H04R 2201/023; H04R 2201/107; H04R 2499/11
USPC ..... 381/371, 374, 384, 386
See application file for complete search history.

(56) References Cited

U.S. PATENT DOCUMENTS 1,329,029 A 1/1920 Timmons
1,418,388 A 6/1922 Miessner
(Continued)

FOREIGN PATENT DOCUMENTS

CA 2515558 A1 2/2007
CA 2697029 A1 2/2007
(Continued)

OTHER PUBLICATIONS

Amazon.com: SF Cable, 3.5mm Female to 2 3.5mm Male Stereo Splitter Cable (6 inches): Electronics. "http://web.archive.org/web/20110716034847/http://www.amazon.com/SF-Cable-Female-Stereo-Splitter/dp/B0016LDZ36?," Jul. 16, 2011.*
(Continued)

*Primary Examiner* — Sean H Nguyen
(74) *Attorney, Agent, or Firm* — TraskBritt, P.C.

(57) ABSTRACT

Modular audio systems comprise two speaker assemblies and a wiring system. Each speaker assembly may comprise a speaker and an audio jack integral to each speaker assembly. The wiring system comprises a first wiring assembly comprising two audio jacks configured to connect to the audio jacks of the two speaker assemblies and two wires connected to the two audio jacks at first ends of the two wires. Headphone assemblies may comprise two speaker assemblies and a headband configured for removable attachment to the speaker assemblies. Each speaker assembly may comprise an attachment structure configured for attachment to another device or structure, wherein the attachment structure of each speaker assembly of the two speaker assemblies comprises a frustoconical surface and two first attachment features comprising elongated features on the frustoconical surface.

10 Claims, 10 Drawing Sheets

(51) Int. Cl.
*H04R 1/10* (2006.01)
*H04R 5/033* (2006.01)

(52) U.S. Cl.
CPC ..... *H04R 1/021* (2013.01); *H04R 1/028* (2013.01); *H04R 1/1041* (2013.01); *H04R 1/1075* (2013.01); *H04R 5/0335* (2013.01); *H04R 2201/023* (2013.01); *H04R 2201/10* (2013.01); *H04R 2201/107* (2013.01); *H04R 2499/11* (2013.01)

(56) References Cited

U.S. PATENT DOCUMENTS

| | | | | |
|---|---|---|---|---|
| 3,938,614 | A | 2/1976 | Ahs | |
| 5,551,089 | A | 9/1996 | Whidden | |
| 5,625,171 | A | 4/1997 | Marshall | |
| 5,625,903 | A | 5/1997 | Schultz et al. | |
| 6,888,950 | B2 | 5/2005 | Siskin et al. | |
| 7,120,268 | B2 * | 10/2006 | Murozaki et al. | 381/381 |
| 7,187,948 | B2 | 3/2007 | Alden | |
| 7,245,736 | B2 | 7/2007 | Tsunoda et al. | |
| D549,883 | S | 8/2007 | Dion | |
| 7,388,960 | B2 | 6/2008 | Kuo et al. | |
| 7,395,090 | B2 | 7/2008 | Alden | |
| 7,512,414 | B2 | 3/2009 | Jannard et al. | |
| 7,519,192 | B1 | 4/2009 | Laycock et al. | |
| D623,627 | S | 9/2010 | Alden et al. | |
| D624,057 | S | 9/2010 | Kelly et al. | |
| 7,869,608 | B2 | 1/2011 | Sander et al. | |
| D641,003 | S | 7/2011 | Alden | |
| 8,014,824 | B2 | 9/2011 | Alden | |
| D650,356 | S | 12/2011 | Alden et al. | |
| 8,111,859 | B2 | 2/2012 | Phillips | |
| D656,129 | S | 3/2012 | Kelly et al. | |
| D665,776 | S | 8/2012 | Alden et al. | |
| D665,777 | S | 8/2012 | Alden et al. | |
| D673,136 | S | 12/2012 | Kelly et al. | |
| D673,140 | S | 12/2012 | Kelly et al. | |
| D674,372 | S | 1/2013 | Kelly et al. | |
| D674,376 | S | 1/2013 | Kelly et al. | |
| D676,023 | S | 2/2013 | Kelly et al. | |
| D676,024 | S | 2/2013 | Kelly et al. | |
| D677,241 | S | 3/2013 | Kelly et al. | |
| D683,717 | S | 6/2013 | Kelly et al. | |
| 8,457,557 | B2 | 6/2013 | Alden | |
| D685,759 | S | 7/2013 | Kelly et al. | |
| D685,767 | S | 7/2013 | Kelly et al. | |
| 8,515,115 | B2 | 8/2013 | Kelly et al. | |
| D689,464 | S | 9/2013 | Bonahoom et al. | |
| D691,582 | S | 10/2013 | Nguyen et al. | |
| D693,793 | S | 11/2013 | Kelly et al. | |
| D699,216 | S | 2/2014 | Bonahoom et al. | |
| D701,193 | S | 3/2014 | Kelly et al. | |
| D701,196 | S | 3/2014 | Kelly et al. | |
| D701,197 | S | 3/2014 | Kelly et al. | |
| 2002/0094094 | A1 | 7/2002 | Shin | |
| 2003/0007660 | A1 | 1/2003 | Tsunoda et al. | |
| 2004/0005071 | A1 | 1/2004 | Siskin et al. | |
| 2004/0157649 | A1 | 8/2004 | Jannard et al. | |
| 2005/0008184 | A1 | 1/2005 | Ito et al. | |
| 2006/0013410 | A1 * | 1/2006 | Wurtz | 381/74 |
| 2008/0144872 | A1 * | 6/2008 | Phillips | 381/333 |
| 2009/0235426 | A1 | 9/2009 | Johnston et al. | |
| 2010/0111349 | A1 * | 5/2010 | Devlas et al. | 381/380 |
| 2010/0284525 | A1 | 11/2010 | Sander et al. | |
| 2011/0235819 | A1 * | 9/2011 | Alden | 381/77 |
| 2012/0148052 | A1 * | 6/2012 | Adam | 381/1 |
| 2012/0275615 | A1 | 11/2012 | Kelly et al. | |
| 2013/0118944 | A1 | 5/2013 | Niiro et al. | |
| 2013/0130540 | A1 | 5/2013 | Oman et al. | |
| 2013/0177165 | A1 | 7/2013 | Oishi | |
| 2013/0177195 | A1 | 7/2013 | Sze et al. | |
| 2013/0185905 | A1 | 7/2013 | Stiff et al. | |
| 2013/0208909 | A1 | 8/2013 | Mülder | |
| 2013/0336514 | A1 | 12/2013 | Kelly et al. | |
| 2014/0056459 | A1 | 2/2014 | Oishi et al. | |

FOREIGN PATENT DOCUMENTS

| | | | |
|---|---|---|---|
| CN | 200980154 | Y | 11/2007 |
| CN | 101095370 | A | 12/2007 |
| EP | 1760896 | A1 | 3/2007 |
| EP | 2262117 | A1 | 12/2010 |
| FR | 2249510 | A1 | 5/1975 |
| KR | 200220309 | Y1 | 4/2001 |
| KR | 100399768 | B1 | 9/2003 |
| KR | 20020052658 | | 9/2003 |
| KR | 20040065582 | | 7/2004 |
| KR | 100631863 | B1 | 10/2006 |
| WO | 03053096 | | 6/2003 |
| WO | 2010068495 | A2 | 6/2010 |
| WO | 2010124190 | A2 | 10/2010 |
| WO | 2011085096 | A2 | 7/2011 |
| WO | 2012024656 | A2 | 2/2012 |

OTHER PUBLICATIONS

Kelly et al., U.S. Appl. No. 61/502,240, filed Jun. 28, 2011.

* cited by examiner

MODULAR AUDIO SYSTEMS AND RELATED ASSEMBLIES AND METHODS

CROSS-REFERENCE TO RELATED APPLICATIONS

This application claims the benefit of the filing date of U.S. Provisional Application Ser. No. 61/584,664, filed Jan. 9, 2012, and titled "Modular Audio Systems and Related Assemblies and Methods," the disclosure of which is incorporated herein in its entirety by this reference. The subject matter of the present application is related to the subject matter of U.S. patent application Ser. No. 12/664,189, filed Dec. 11, 2009, now U.S. Pat. No. 8,542,859, issued Sep. 24, 2013, the disclosure of which is incorporated herein in its entirety by this reference.

FIELD

The disclosure relates generally to modular audio systems. More specifically, disclosed embodiments relate to speaker assemblies that are attachable to headbands to form headphones, disposable in user-wearable clothing and other accessories, and connectable to docks.

BACKGROUND

Conventional portable audio systems often include a pair of headphones that are connected to a media player (e.g., by one or more wires or by wireless technology). It is increasingly common for users to use portable audio systems when engaging in outdoor activities. While the media player in any given portable audio system can be used in a variety of settings, it is often the case that the headphones employed are not as versatile. For example, in-ear headphones may provide for portability, but such headphones may provide poor audio quality, be uncomfortable, or both. Where multiple wires are used to connect the headphone speakers to the media player, each additional connection (e.g., each connection between male and female audio jacks) may further degrade audio quality. While larger, over-the-ear headphones may be more comfortable, they may be awkward to wear with outdoor gear, such as goggles. For example, it is increasingly common for outdoor enthusiasts, such as skiers and snowboarders, to use portable audio systems when engaging in outdoor activities, such as skiing and snowboarding. In most cases, skiers and snowboarders favor smaller, in-ear style headphones because helmets, ski goggles, ear protectors, hoods, and headbands can more easily be worn over such headphones.

BRIEF DESCRIPTION OF THE DRAWINGS

While the specification concludes with claims particularly pointing out and distinctly claiming what are regarded as embodiments of the invention, various features and advantages of disclosed embodiments may be more readily understood from the following description when read in conjunction with the accompanying drawings, in which:

DETAILED DESCRIPTION

The illustrations presented herein are not meant to be actual views of any particular audio system, headphone assembly, or component thereof, but are merely idealized representations employed to describe illustrative embodiments. Thus, the drawings are not necessarily to scale.

Disclosed embodiments relate generally to speaker assemblies that are attachable to headbands to form headphones, disposable in user-wearable accessories, and connectable to docks. More specifically, disclosed are speaker assemblies and modular audio systems that enable users to use a single set of speaker assemblies with a variety of accessories in a variety of different ways and environments.

As used herein, the term "media player" means and includes any device or system capable of producing an audio signal and connectable to a speaker to convert the audio signal to audible sound. For example, media players include portable digital music players, portable CD players, portable cassette players, mobile phones, smartphones, personal digital assistants (PDAs), ebook readers, portable gaming systems, portable DVD players, laptop computers, tablet computers, desktop computers, stereo systems, etc.

As used herein, the term "audio jack" means and includes any connector through which an audio signal (e.g., an analog audio signal) is transmittable and which is used to structurally and electrically connect components of an audio system to one another. For example, audio jacks may be male or female (e.g., plugs or sockets) and may include tip, ring, sleeve (TRS) connectors; tip, sleeve (TS) connectors; tip, ring, ring, sleeve (TRRS) connectors; stereo plugs; mini-jacks; mini-stereo connectors; headphone jacks; and Bantam plugs.

Figure 1:
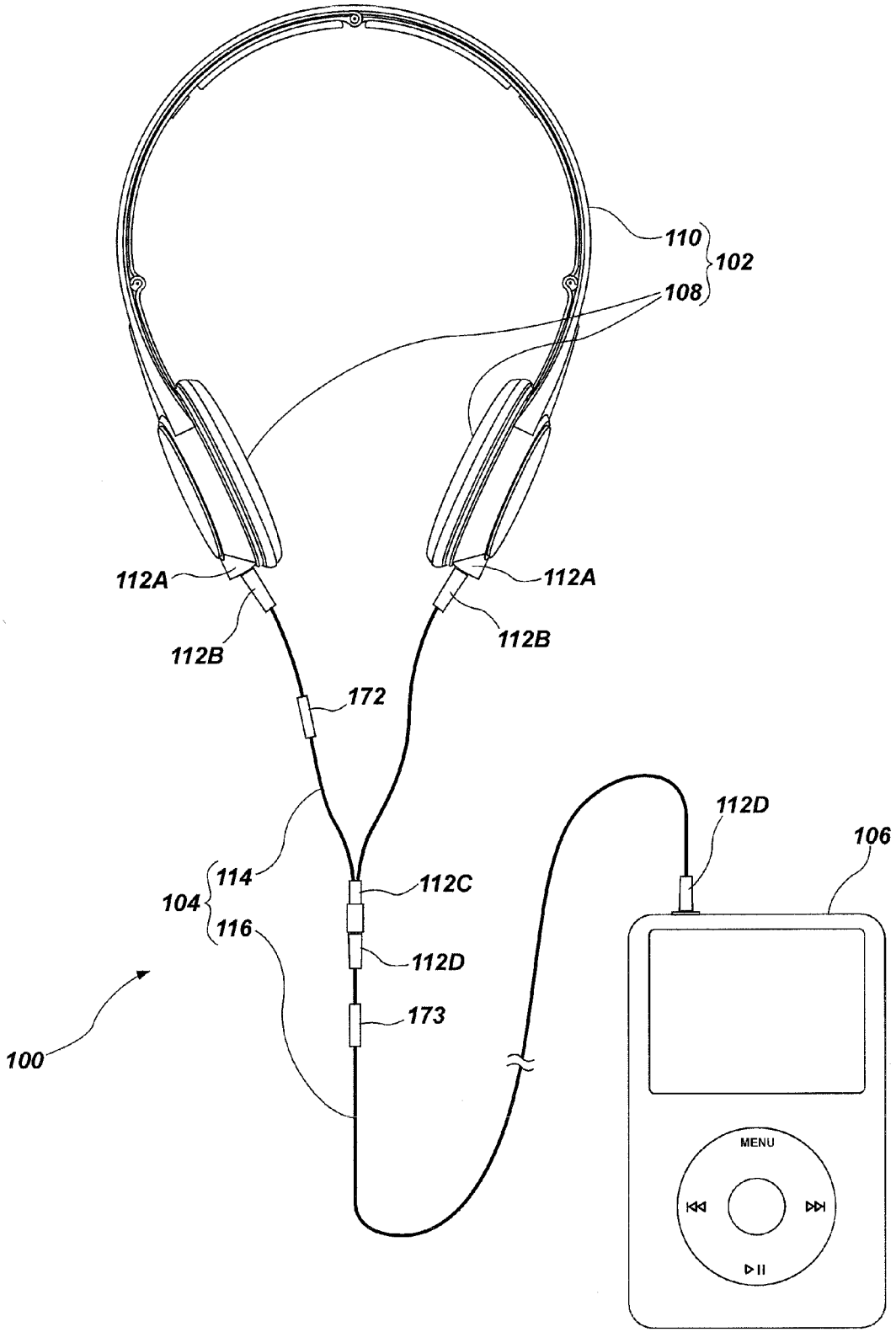
FIG. 1 is a front view of a modular audio system.

Referring to FIG. 1, a front view of a modular audio system 100 is shown. The modular audio system 100 includes a headphone assembly 102, a wiring system 104, and a media player 106. The headphone assembly 102 is connected to the wiring system 104 such that audio signals carried by the wiring system 104 are transmitted to the headphone assembly 102. The wiring system 104 is connected to the media player 106 such that audio signals produced by the media player 106 are transmitted through the wiring system 104. Thus, an audio signal from the media player 106 may be transmitted through the wiring system 104 to the headphone assembly 102 where it is converted to audible sound.

The headphone assembly 102 may comprise two speaker assemblies 108 and a headband 110. The headband 110 may be configured to rest on a user's head and to support the two speaker assemblies 108 when in use. The headband 110 may also be configured to position the two speaker assemblies 108 attached to the headband 110 proximate (e.g., over) a user's ears such that sound from the speaker assemblies 108 may be more easily heard by the user. Additional detail regarding the headband 110 is provided in connection with FIG. 6.

The speaker assemblies 108 may be detachably connected to the wiring system 104. For example, each speaker assembly 108 may comprise an audio jack 112A that may be detachably connected to an audio jack 112B of the wiring system. As a specific, non-limiting example, the audio jack 112A of each speaker assembly 108 may comprise a female tip, ring, sleeve (TRS) connector (e.g., a jack socket) connected to audio jacks 112B of the wiring system 104 comprising male TRS connectors (e.g., jack plugs). The audio jack 112A of each speaker assembly 108 may be integral to the speaker assembly 108. In other words, there may not be any external wires permanently connected to the speaker assembly 108 connecting the audio jack 112A to the speaker assembly 108. In alternative embodiments, the speaker assemblies 108 may be permanently connected to the wiring system 104.

The speaker assemblies 108 may be removably attached to the headband 110. Thus, the speaker assemblies 108 may be detachable from both the wiring system 104 and the headband 110 and connectable to another device or system for use with that other device or system. The speaker assemblies 108 may be attached to the headband 110 such that manual rotation of the speaker assemblies 108 with respect to the headband 110 detaches the speaker assemblies 108 from the headband 110. Accordingly, the speaker assemblies 108 may be quickly and easily removed from such a modular audio system 100 and employed with another modular device or system such that a single set of speaker assemblies 108 are usable with a variety of accessories in a variety of different ways and environments. Additional detail regarding the speaker assemblies 108 is discussed with reference to FIGS. 2 through 5.

The wiring system 104 may comprise a first wiring assembly 114 and a second wiring assembly 116. The first wiring assembly 114 may be detachably connected to the headphone assembly 102, the second wiring assembly 116 may be detachably connected to the media player 106, and the first and second wiring assemblies 114 and 116 may be detachably connected to one another to form the wiring system 104 and to connect the headphone assembly 102 to the media player 106. In alternative embodiments, the wiring system 104 may comprise a single, unitary wiring assembly extending from the headphone assembly 102 to the media player 106 or may comprise more than two wiring assemblies interconnected to one another to connect the headphone assembly 102 to the media player 106. Additional detail regarding the first and second wiring assemblies 114 and 116 is discussed with reference to FIGS. 7 and 8, respectively.

Figure 2:
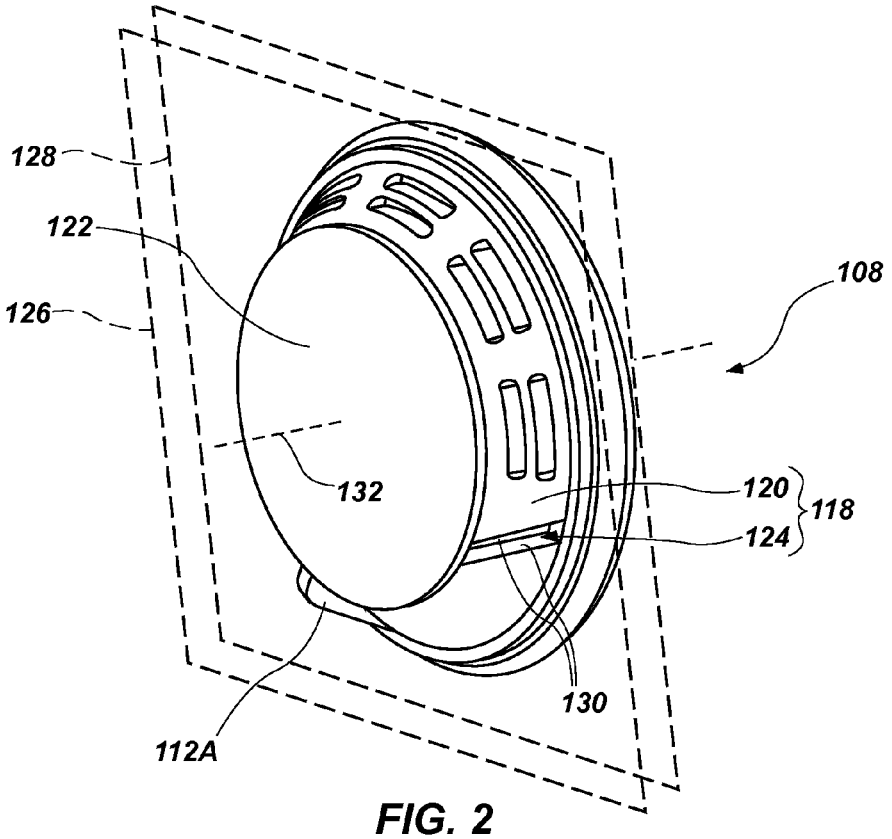
FIG. 2 is a perspective view of a speaker assembly of the modular audio system of FIG. 1.

Referring to FIG. 2, a perspective view of a speaker assembly 108 of the modular audio system 100 of FIG. 1 is shown. The speaker assembly 108 comprises an attachment structure 118 configured for attachment to another device or structure (e.g., to a headband 110 (see FIG. 1)). The attachment structure 118 may comprise, for example, a frustoconical surface 120 of a housing structure 122 and two or more first attachment features 124 on the frustoconical surface 120. The first attachment features 124 may be elongated. For example, the first attachment features 124 may extend across the entire frustoconical surface 120. More specifically, the first attachment features 124 may extend, for example, from a rear plane 126 intersecting the frustoconical surface 120 to a front plane 128 intersecting the frustoconical surface 120 to define the frustoconical shape of the frustoconical surface 120. The first attachment features 124 may comprise, for example, slots extending into the frustoconical surface 120 for receiving at least portions of protrusions on another device or structure, as shown in FIG. 2. In alternative embodiments, the first attachment features 124 may comprise, for example, protrusions extending from the frustoconical surface 120 for at least partial insertion into slots in another device or structure. The first attachment features 124 may be generally rectangular in cross-sectional shape, with opposing sidewalls 130 defining the first attachment features 124 being parallel or substantially parallel to one another. The opposing sidewalls 130 defining the first attachment features 124 may extend in a direction oblique to a central axis 132 of the speaker assembly 108. For example, the first attachment features 124 may slant upwardly (when the speaker assembly 108 is oriented with the audio jack 112A facing downwardly) such that the opposing sidewalls 130 defining the first attachment features 124 may extend in a direction oblique to the central axis 132 of the speaker assembly 108.

Figure 3:
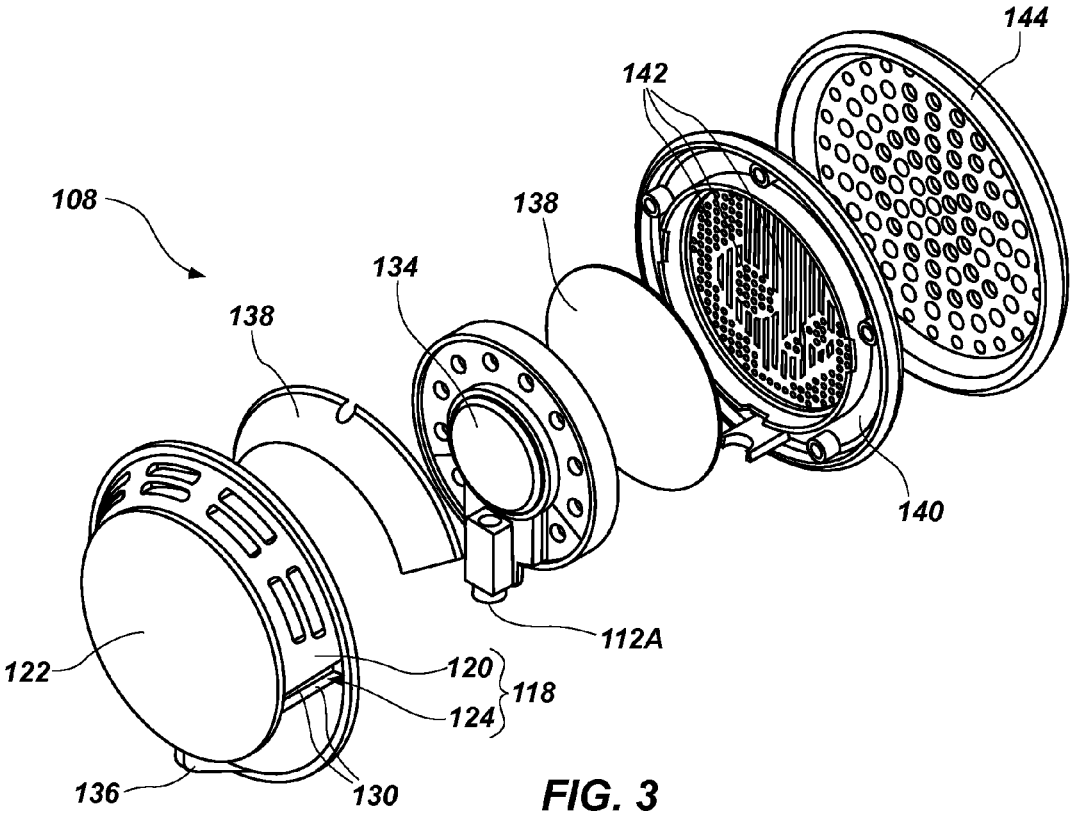
FIG. 3 is an exploded perspective view of the speaker assembly of FIG. 2.

Referring to FIG. 3, an exploded perspective view of the speaker assembly 108 of FIG. 2 is shown. As stated previously, the speaker assembly 108 may comprise a housing structure 122. The housing structure 122 may comprise a rear housing portion configured to receive a speaker 134 at least partially within the housing structure 122. An access port 136 may enable an audio jack 112 (e.g., an audio jack 112B of the first wiring assembly 114 (see FIG. 1)) to detachably connect to an audio jack 112A connected to the speaker 134. A layer of acoustic felt 138 may be interposed between the housing structure 122 and the speaker 134. The speaker 134 may be connected to an audio jack 112A (e.g., a female TRS connector), which may be accessible through the access port 136. Another layer of acoustic felt 138 may be interposed between the speaker 134 and a front housing 140 configured for attachment to the housing structure 122. The front housing 140 may include a plurality of openings 142, which may enable sound from the speaker 134 to more easily exit the speaker assembly 108 and be heard by a user. When the housing structure 122 and the front housing 140 are attached to one another, they may cooperatively form a housing in which the speaker 134 and the layers of acoustic felt 138 are enclosed. The housing structure 122 and the front housing 140 may be attached to one another by, for example, screws, bolts, rivets, an adhesive, a snap fit, an interference fit, or other attachments known in the art. Thus, the audio jack 112A and the speaker 134 of the speaker assembly 108 may be located within the housing (i.e., within the housing structure 122 and the front housing 140) and be accessed through the housing. The speaker assembly 108 may include an optional earpad 144, which may provide a cushion to increase comfort of a user when the speaker assembly 108 contacts or is pressed against an ear of a user. The optional earpad 144 may be removably attached to the front housing 140, for example, by slipping the earpad 144 over and around the front housing 140. The optional earpad 144 may also extend around at least a portion of the housing structure 122 in some embodiments.

The housing structure 122 and the front housing 140 may be formed from materials known in the art for use in headphone assemblies 102 (see FIG. 1). For example, the housing structure 122 and the front housing 140 may comprise thermoplastics. The speaker 134 may be any speaker known in the art for use in headphone assemblies 102 (see FIG. 1).

Figure 4:
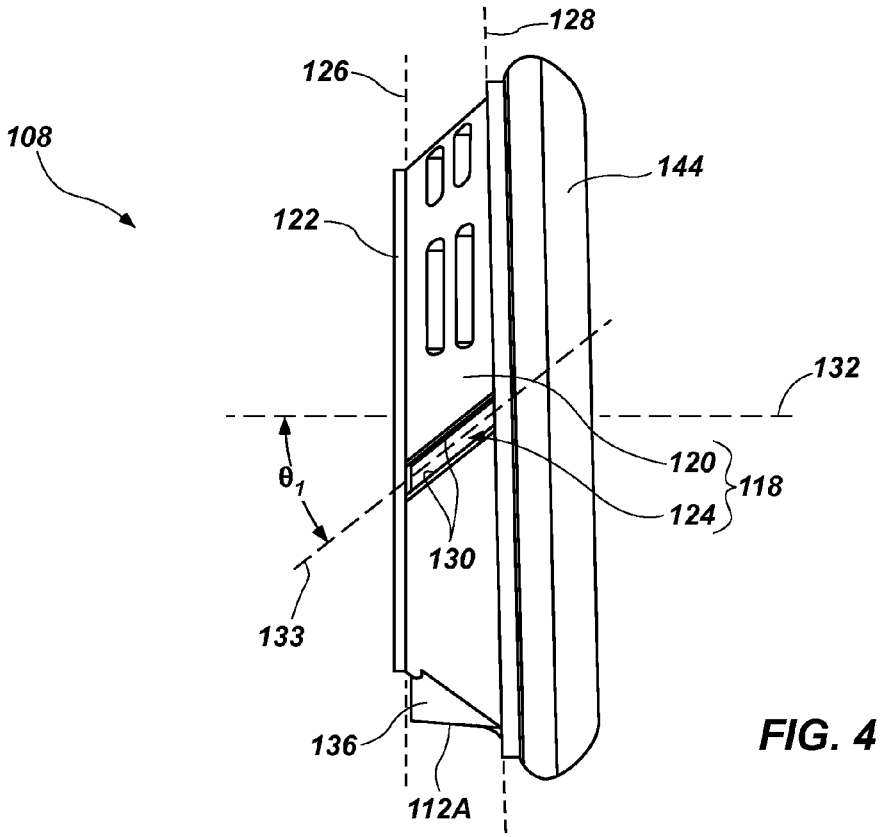
FIG. 4 is a side view of the speaker assembly of FIG. 2.

Referring to FIG. 4, a side view of the speaker assembly 108 of FIG. 2 is shown. As previously stated, the first attachment feature 124 may slant upwardly (when the speaker assembly 108 is oriented with the audio jack 112A facing downwardly). More specifically, the first attachment feature 124 may extend at a first angle of inclination $\theta_1$ defined by an included angle between the central axis 132 of the speaker assembly 108 and a central axis 133 of the first attachment feature 124. The central axis 133 of the first attachment feature 124 may be located between the sidewalls 130 (e.g., equidistant from each sidewall 130) and extend in a direction parallel to the sidewalls 130. The first angle of inclination $\theta_1$ of the first attachment feature 124 may be between about 15° and about 75°. More specifically, the first angle of inclination $\theta_1$ of the first attachment feature 124 may be between about 20° and about 60°.

Figure 5:
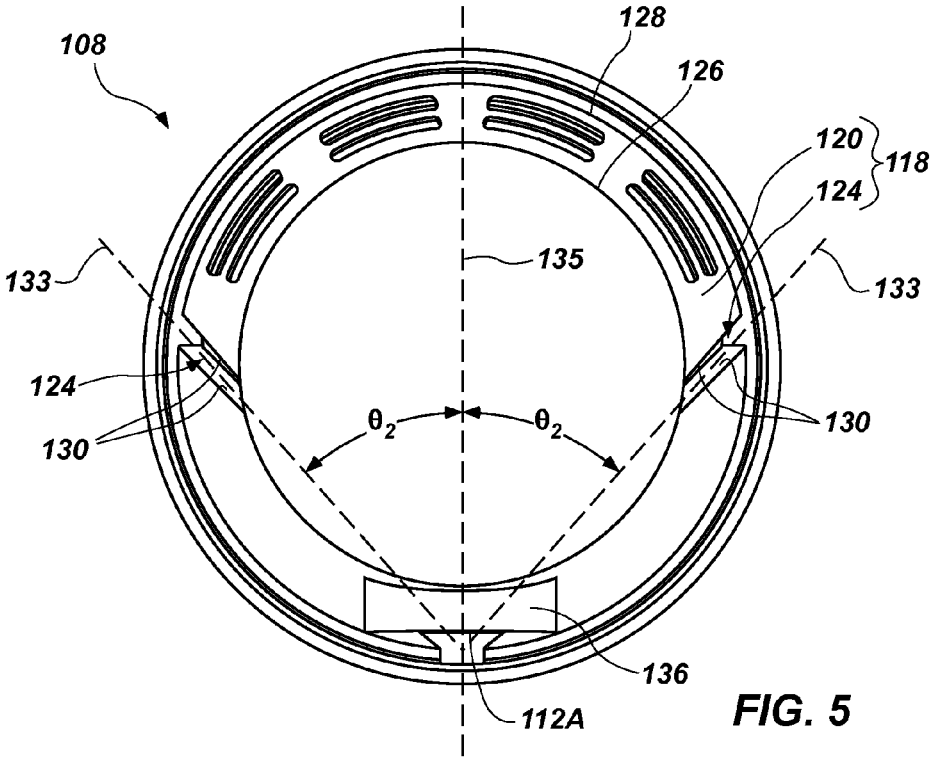
FIG. 5 is a rear view of the speaker assembly of FIG. 2.

Referring to FIG. 5, a rear view of the speaker assembly 108 of FIG. 2 is shown. The first attachment feature 124 may extend at a second angle of inclination $\theta_2$ defined by an included angle between a rear axis 135 of the attachment structure 118 and a central axis 133 of the first attachment feature 124. The rear axis 135 of the attachment structure 118 may be defined by a line perpendicularly intersecting the central axis 132 (see FIG. 4) of the speaker assembly 108 and extending in a vertical direction when the speaker assembly 108 is oriented with the audio jack 112A facing downwardly. The second angle of inclination $\theta_2$ of the first attachment feature 124 may be between about 15° and about 75°. More specifically, the second angle of inclination $\theta_2$ of the first attachment feature 124 may be between about 35° and about 55°.

Figure 6:
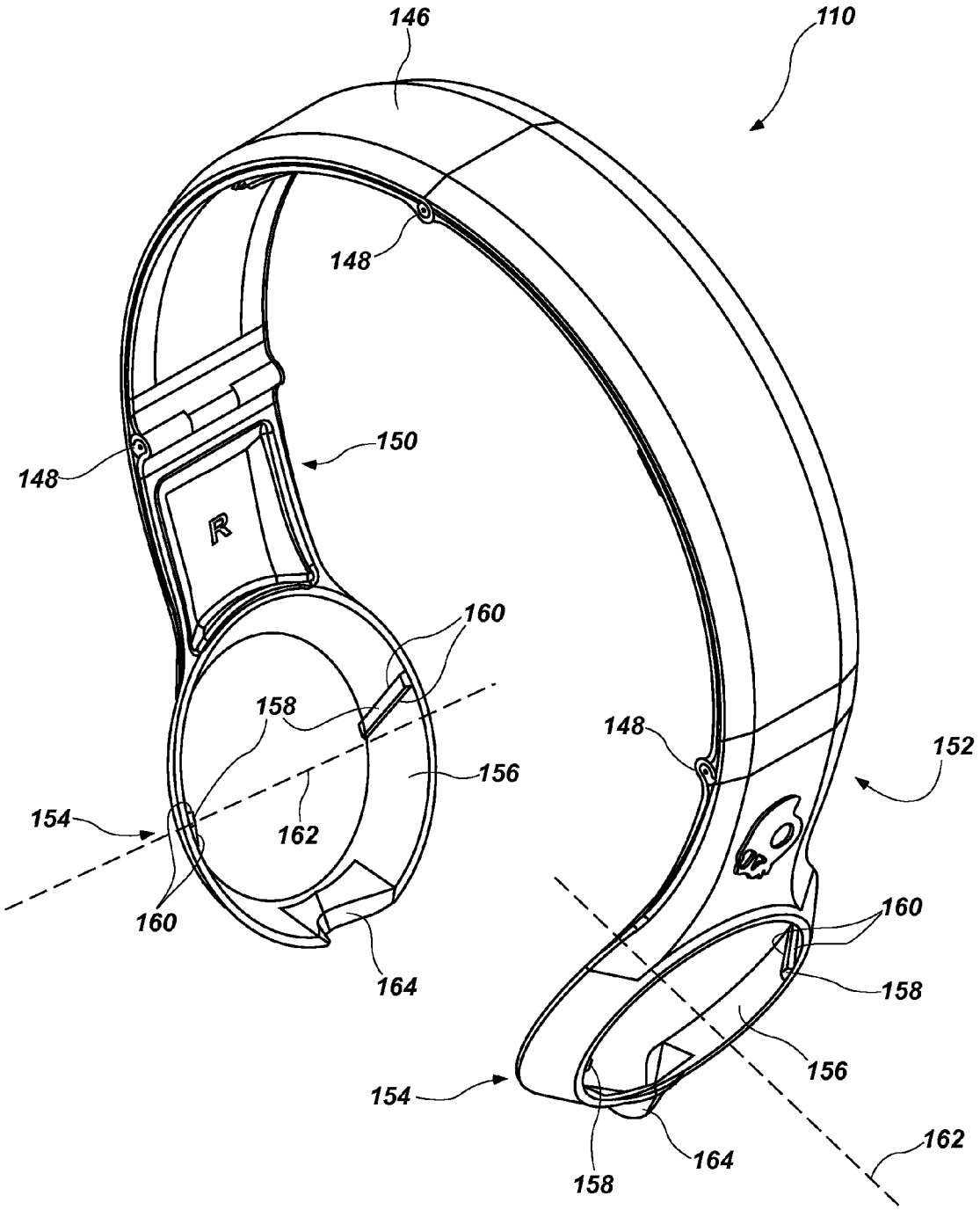
FIG. 6 is a perspective view of a headband of the modular audio system of FIG. 1.

Referring to FIG. 6, a perspective view of the headband 110 of the modular audio system 100 of FIG. 1 is shown. The headband 110 comprises a band 146 configured for placement over a head of a user. When in use, the band 146 may support the speaker assemblies 108 (see FIG. 1) by resting on the head of the user. The band 146 may be collapsible for storage or ease in transport. For example, the band 146 may include at least one hinge 148. As a specific, non-limiting example, the band 146 may include a hinge 148 at an apex of the band 146, a hinge 148 in a right arm 150 of the band 146, and a hinge in a left arm 152 of the band 146. Thus, the right and left arms 150 and 152 of the band 146 may swivel upwardly and the apex of the band 146 may be folded in half to place the headband 110 (and the headphone assembly 102 (see FIG. 1)) in a compact state for storage or transport.

The headband 110 includes two attachment portions 154 at opposing ends of the band 146 configured for attachment to the attachment structures 118 of speaker assemblies 108 (see FIG. 2). The attachment portions 154 may extend from the respective ends of the right and left arms 150 and 152 of the band 146. The attachment portions 154 may be located to position speaker assemblies 108 (see FIG. 1) attached to the attachment portions 154 over the ears of a user. The right and left arms 150 and 152 may be extensible, enabling a user to adjust the positioning of the attachment portions 154, and the speaker assemblies 108 (see FIG. 1) removably attached to the attachment portions 154, to accommodate different head sizes and ear positions. The attachment portions 154 may include access indentations 164 configured to accommodate the access ports 136 of the speaker assemblies 108 (see FIG. 3).

Each attachment portion 154 may comprise, for example, a mating frustoconical surface 156 configured to abut against and conform to the frustoconical surface 120 of the attachment structure 118 of a speaker assembly 108 (FIG. 2) and two or more second attachment features 158 configured to engage with the first attachment features 124 on the frustoconical surface 120 of the attachment structure 118 of the speaker assembly 108 (FIG. 2). The second attachment features 158 may be elongated. For example, the second attachment features 158 may extend across the entire mating frustoconical surface 156. The second attachment features 158 may comprise, for example, protrusions extending from the mating frustoconical surface 156 for at least partial insertion into slots of the first attachment features 124, (see FIG. 2), as shown in FIG. 6. In alternative embodiments, the second attachment features 158 may comprise, for example, slots extending into the mating frustoconical surface 156 for receiving at least portions of protrusions of the first attachment features 124. The second attachment features 158 may be generally rectangular in cross-sectional shape, with opposing sidewalls 160 of the second attachment features 158 being parallel or substantially parallel to one another. The opposing sidewalls 160 of the second attachment features 158 may extend in a direction oblique to a central axis 162 of the attachment portion 154. For example, the second attachment features 158 may slant upwardly (when the access indentations 164 are positioned at a bottom of the headband 110) such that the opposing sidewalls 160 of the second attachment features 158 may extend in a direction oblique to a central axis 162 of the attachment portion 154.

The headband 110 may be formed from materials known in the art for use in headphone assemblies 102 (see FIG. 1). For example, the headband 110 may comprise a thermoplastic.

With combined reference to FIGS. 2 and 6, the attachment portions 154 of the headband 110, the attachment structures 118 of the speaker assemblies 108, or both may elastically deform and snap back into shape when the attachment structures 118 of the speaker assemblies 108 are removably attached to the attachment portions 154. More specifically, the second attachment features 158 may snap into the first attachment features 124 and mechanical interference between the second attachment features 158 and the surfaces defining the first attachment features 124 may retain the speaker assemblies 108 attached to the headband 110. Thus, the speaker assemblies 108 may be removably attached to the headband 110 using a snap fit.

To detach the speaker assemblies 108 from the headband 110, the speaker assemblies 108 may be rotated relative to the headband 110, which may cause the attachment portions 154 of the headband 110, the attachment structures 118 of the speaker assemblies 108, or both to elastically deform and release the speaker assemblies 108 from the headband 110. More specifically, the speaker assemblies 108 may be rotated about axes transverse to the central axes 132 and 162 of the speaker assemblies 108 and the attachment portion 154, respectively. Still more specifically, the speaker assemblies 108 may be rotated about axes transverse to the central axes 132 and 162 of the speaker assemblies 108 and the attachment portion 154, respectively, and passing through the access indentations 164. Thus, the second attachment features 158 may be extracted from the first attachment features 124, and the speaker assemblies 108 may be detached from the headband 110.

Figure 7:
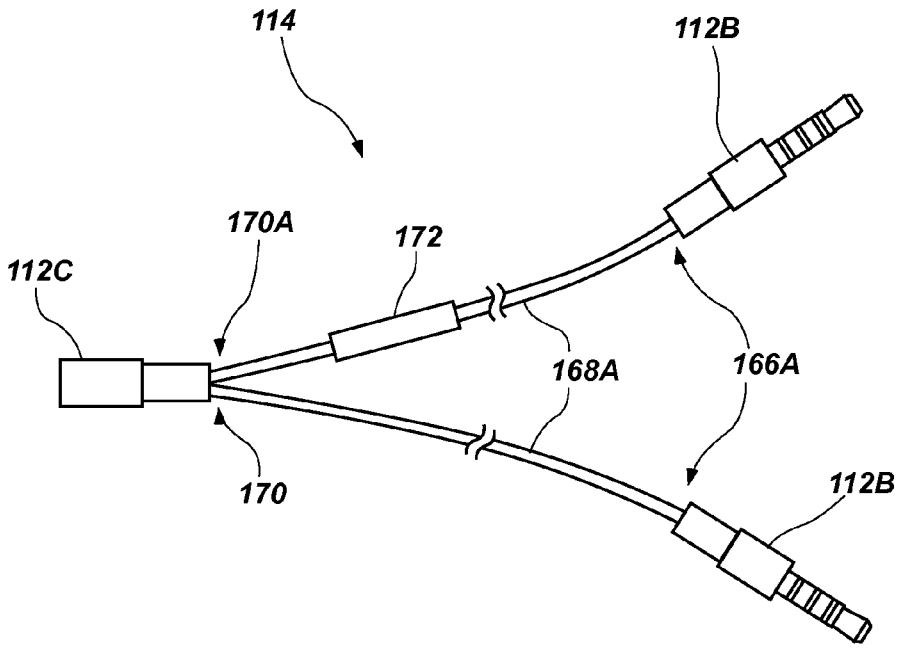
FIG. 7 is a front of a wiring assembly of the modular audio system of FIG. 1.

Referring to FIG. 7, a front view of the first wiring assembly 114 of the modular audio system 100 of FIG. 1 is shown. The first wiring assembly 114 may comprise two audio jacks 112B configured to connect to the audio jacks 112A of the two speaker assemblies 108 and located at the first ends 166A of two wires 168A. As a specific, non-limiting example, the two audio jacks 112B may comprise male TRS connectors. The first wiring assembly 114 may further comprise another audio jack 112C connected to the two wires 168A at second, opposing ends 170A of the wires 168A. As a specific, non-limiting example, the other audio jack 112C may comprise a female TRS or tip, ring, ring, sleeve (TRRS) connector. The other audio jack 112C may, therefore, be a "Y" juncture connecting the two wires 168A and splitting an audio signal, for example, into right and left ear portions (e.g., for stereo sound). In some embodiments, a microphone assembly 172 may be connected to one or both of the wires 168A of the first wiring assembly 114 between the two audio jacks 112B and the other audio jack 112B. In other embodiments, such a microphone assembly 172 may not be connected to the wires 168A of the first wiring assembly 114, but may be connected to a wire 168B (see FIG. 8) of the second wiring assembly 116.

Figure 8:
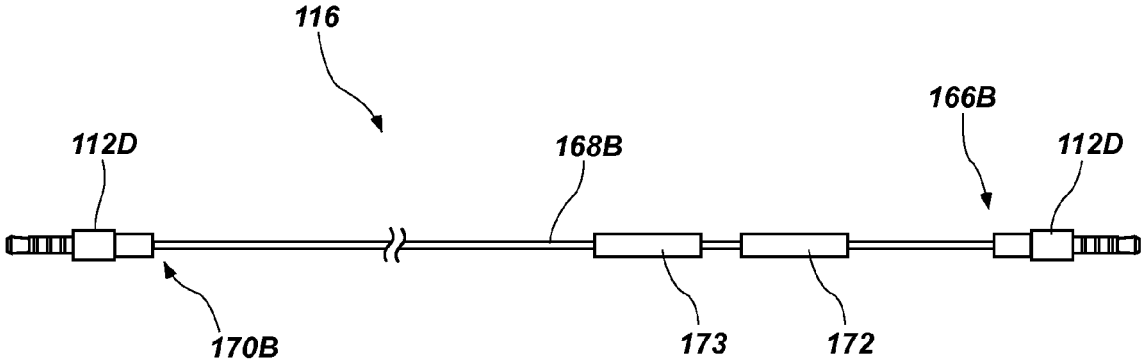
FIG. 8 is a front view of another wiring assembly for use with the modular audio system of FIG. 1.

Referring to FIG. 8, a front view of a second wiring assembly 116 for use with the modular audio system 100 of FIG. 1 is shown. The second wiring assembly 116 may comprise a first audio jack 112D configured to connect to the other audio jack 112C of the first wiring assembly 114 located at a first end 166B of a wire 168B. As a specific, non-limiting example, the first audio jack 112D may comprise a male TRS or TRRS connector. In alternative embodiments, the first and second wiring assemblies 114 and 116 may be permanently connected to one another. In such alternative embodiments, the first audio jack 112D of the second wiring assembly 116 and the other audio jack 112C of the first wiring assembly 114 may be omitted, and a permanent "Y" juncture connecting the two wires 168A of the first wiring assembly 114 and transitioning into the second wiring assembly 116 may be provided. The second wiring assembly 116 may further comprise a second audio jack 112D configured to connect to a media player 106 (see FIG. 1) and located at a second, opposing end 170B of the wire 168B. As a specific, non-limiting example, the second audio jack 112D may comprise a male TRRS connector.

The second wiring assembly 116 may further comprise a microphone assembly 172 in some embodiments. The microphone assembly 172 may include a microphone configured to produce audio signals in response to sounds and to transmit those audio signals to the second audio jack 112D at the second, opposing end 170B of the wire 168B. The microphone assembly 172 may be connected to the wire 168B in between the first and second audio jacks 112D at the first and second, opposing ends 166B and 170B of the wire 168B, respectively. The microphone assembly 172 may further include additional controls, for example, to increase and decrease volume, start and stop media play, activate voice control. Examples of methods and apparatuses for such a microphone assembly 172 are disclosed at least in U.S. Pat. No. 7,869,608, issued Jan. 11, 2011, to Sander et al., and U.S. Patent Application Pub. No. 2010/0284525, published May 8, 2009, to Sander et al., the disclosure of each of which is incorporated herein in its entirety by this reference. The microphone assembly 172 may be located along the length of the wire 168B at a position proximate to a user's mouth or vocal chords when the modular audio system 100 (see FIG. 1) is in use. In some embodiments, a modular audio system 100 (see FIG. 1) may include multiple second wiring assemblies 116 with the microphone assembly 172 located at different positions along the length of the wire 168B and optionally including different lengths of wire 168B such that a particular second wiring assembly 116 may be selected to place the microphone assembly 172 proximate the mouth or vocal chords of a user for a chosen activity or configuration of the modular audio system 100. In addition, some embodiments of second wiring assemblies 116 may not include such microphone assemblies 172 (see FIG. 1), and such microphone assemblies 172 may be included in first wiring assemblies 114 (see FIGS. 1 and 7).

In some embodiments, the second wiring assembly 116 may include an amplifier 173 configured to increase the power of an audio signal transmitted through the second wiring assembly 116. For example, the amplifier 173 may comprise a powered, in-line amplifier 173 and may be selectively activated and deactivated by a user to increase or not increase the power of an audio signal transmitted through the second wiring assembly 116. In other embodiments, an amplifier 173 may be separately included and attachable to one or both of the first and second wiring assemblies 114 and 116, may be included in-line in the first wiring assembly 114, or may be disposed in one or both of the speaker assemblies 108.

Figure 9:
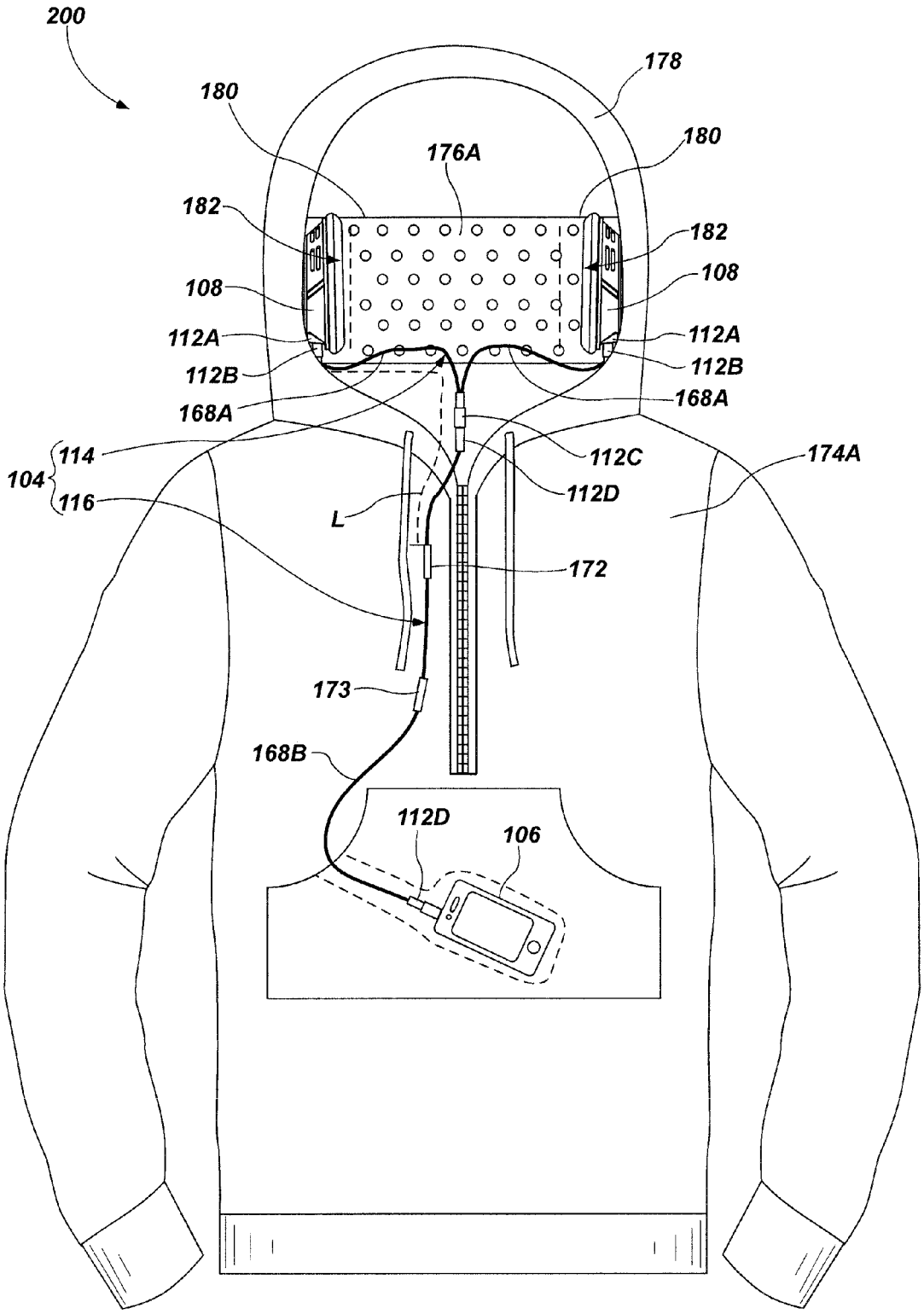
FIGS. 9 through 13 are views of modular audio systems including user-wearable accessories comprising mesh liners for receiving speaker assemblies.

FIGS. 9 through 13 are views of modular audio systems 100 (see FIG. 1) including user-wearable accessories 174 configured for receiving speaker assemblies 108. Referring specifically to FIG. 9, a front view of another embodiment of a modular audio system 200 is shown. Such a modular audio system 200 may include a user-wearable accessory 174A, at least one speaker assembly 108 (e.g., a pair of speaker assemblies 108), a wiring system 104, and a media player 106. The user-wearable accessory 174A may comprise, for example, a hood 178, which may be a portion of a jacket, a coat, a sweater, or a sweatshirt (sometimes referred to in the art as a "hoodie"). The speaker assemblies 108 may be configured for placement in the hood 178. For example, a mesh liner 176A configured to receive speaker assemblies 108 may be attached to an inner portion of the hood 178. Sound from the speaker assemblies 108 may pass through such a mesh liner 176A in an unmuffled or substantially unmuffled state as compared to sounds passing through other materials that may be used to form liners in hoods 178. For example, the mesh liner 176A may be sewn, adhered, attached with hook and loop fasteners (e.g., VELCRO®), or attached with a zipper or zippers to the inner portion of the hood 178. The mesh liner 176A may extend from a first side of the hood 178, around a back of the hood 178, to a second, opposing side of the hood 178 in some embodiments. In other embodiments, the mesh liner 176A may only be disposed on the first and second, opposing sides of the hood 178. The first and second, opposing sides of the hood 178 lined by the mesh liner 176A may be located proximate a user's ears when the user is wearing the user-wearable accessory 174A, and particularly when the user dons the hood 178. In alternative embodiments, the speaker assemblies 108 may be placed in an inner portion of a collar, as disclosed in U.S. Pat. No. 8,014,824, issued Sep. 6, 2011, to Alden, the disclosure of which is incorporated herein in its entirety by this reference. For example, a mesh liner 176A may be attached to the inner portion of such a collar and configured to receive the speaker assemblies 108.

The speaker assemblies 108 may be placed in the hood 178 on the first and second, opposing sides of the hood 178. For example, openings 180 may be formed in the mesh liner 176A and the speaker assemblies 108 may be slipped through the openings 180 into the mesh liner 176A. The speaker assemblies 108 may optionally be secured within the mesh liner 176A by closing the openings 180, for example, using zippers, buttons, snaps, or hook and loop fasteners. The mesh liner 176A may include discrete compartments 182 for containing the speaker assemblies 108. The speaker assemblies 108 may be movable within the discrete compartments 182, and specific motions may enable a user to control the media player 106, as disclosed in U.S. Provisional Patent Application No. 61/502,240, filed Jun. 28, 2011, to Kelly et al., the disclosure of which is incorporated herein in its entirety by this reference.

The mesh liner 176A may include at least one aperture through which the wiring system 104, or at least portions thereof, may pass. For example, the first wiring assembly 114 may extend from the speaker assemblies 108 within the mesh liner 176A to a rear of the hood 178 and pass through an aperture in the mesh liner 176A at the rear of the hood 178. In alternative embodiments, the wiring system 104 may extend from the speaker assemblies 108, through the openings 180 through which the speaker assemblies 108 were inserted, and out of the hood 178. The second wiring assembly 116 may connect to the first wiring assembly 114 and extend out of the hood 178 to a media player 106 (e.g., in a pocket of the user-wearable accessory 174A). Thus, the microphone assembly 172 may be located outside the hood 178 because the microphone assembly 172 is connected to the wire 168B of the second wiring assembly 116, and not to the wires 168A of the first wiring assembly 114.

The microphone assembly 172 may be distanced from the speaker assemblies 108 to position the microphone assembly 172 near the mouth or vocal cords of a user. For example, a length L of the wiring system 104, including audio jacks 112 (e.g., audio jacks 112B, 112C, and 112D) and wire 168A and 168B, between the audio jack 112A of the speaker assembly 108 and the microphone assembly 172 may be between about 35 cm and about 65 cm. More specifically, the length L of the wiring system 104 between the audio jack 112A of the speaker assembly 108 and the microphone assembly 172 may be between about 45 cm and about 55 cm.

The speaker assemblies 108 may be secured within the mesh liner 176A in some embodiments. For example, the openings 180 of the discrete compartments 182 formed in the mesh liner 176A may be secured shut by buttoning, snapping, zipping, or securing using hook and loop fasteners the mesh liner 176A to itself or to the hood 178 to close the openings 180. In alternative embodiments, the openings 180 may remain open, and gravity and friction may keep the speaker assemblies 108 in the mesh liner 176A.

Figure 10:
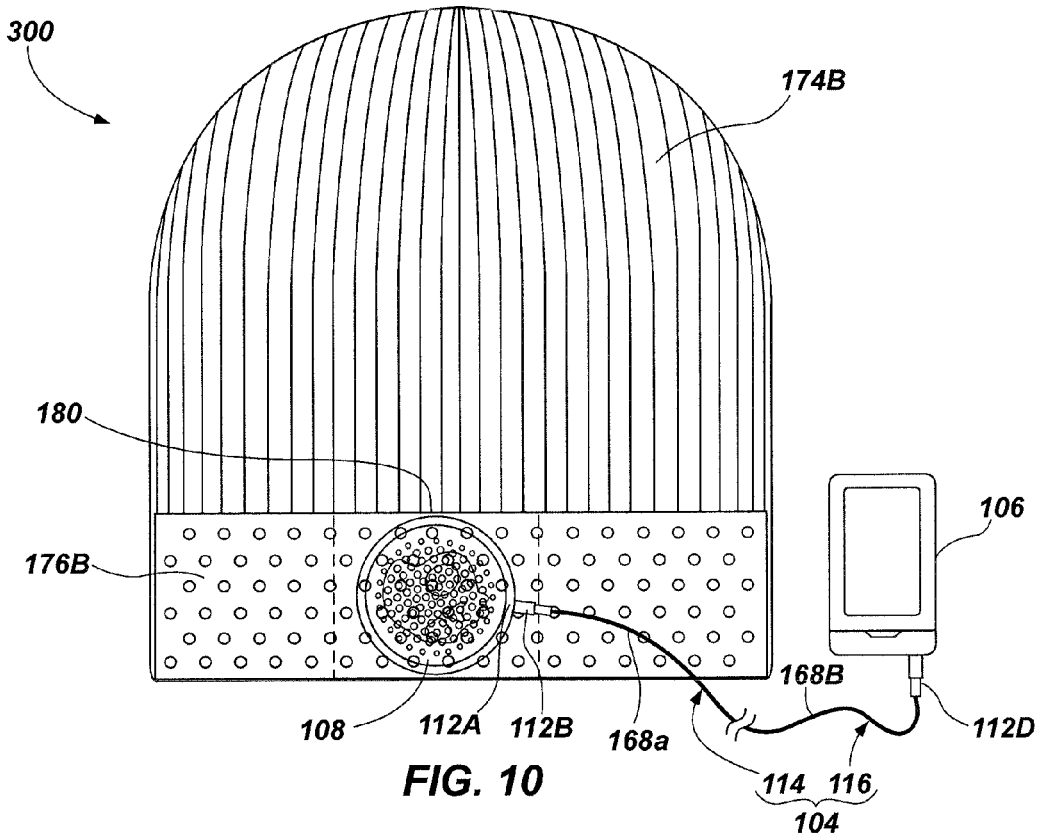

Referring specifically to FIG. 10, a cross-sectional view of another embodiment of a modular audio system 300 is shown. Such a modular audio system 300 may include a user-wearable accessory 174B, at least one speaker assembly 108 (e.g., a pair of speaker assemblies 108), a wiring system 104, and a media player 106. The user-wearable accessory 174B may comprise, for example, a skull cap (sometimes referred to in the art as a tuque or a "beanie"), which may comprise a knit or a woven fabric. In this view, an interior side of the skull cap is shown. The speaker assemblies 108 may be configured for placement in the skull cap. For example, a mesh liner 176B configured to receive speaker assemblies 108 may be attached to an inner portion of the skull cap. For example, the mesh liner 176B may be sewn, adhered, attached with hook and loop fasteners (e.g., VELCRO®), or attached with a zipper or zippers to the inner portion of the skull cap. The mesh liner 176B may extend entirely around the skull cap in some embodiments. In other embodiments, the mesh liner 176B may extend from a first side of the skull cap, around a back of the skull cap, to a second, opposing side of the skull cap, or may only be disposed on the first and second, opposing sides of the skull cap. The first and second, opposing sides of the skull cap lined by the mesh liner 176B may be located proximate a user's ears when the user is wearing the skull cap.

Figure 11:
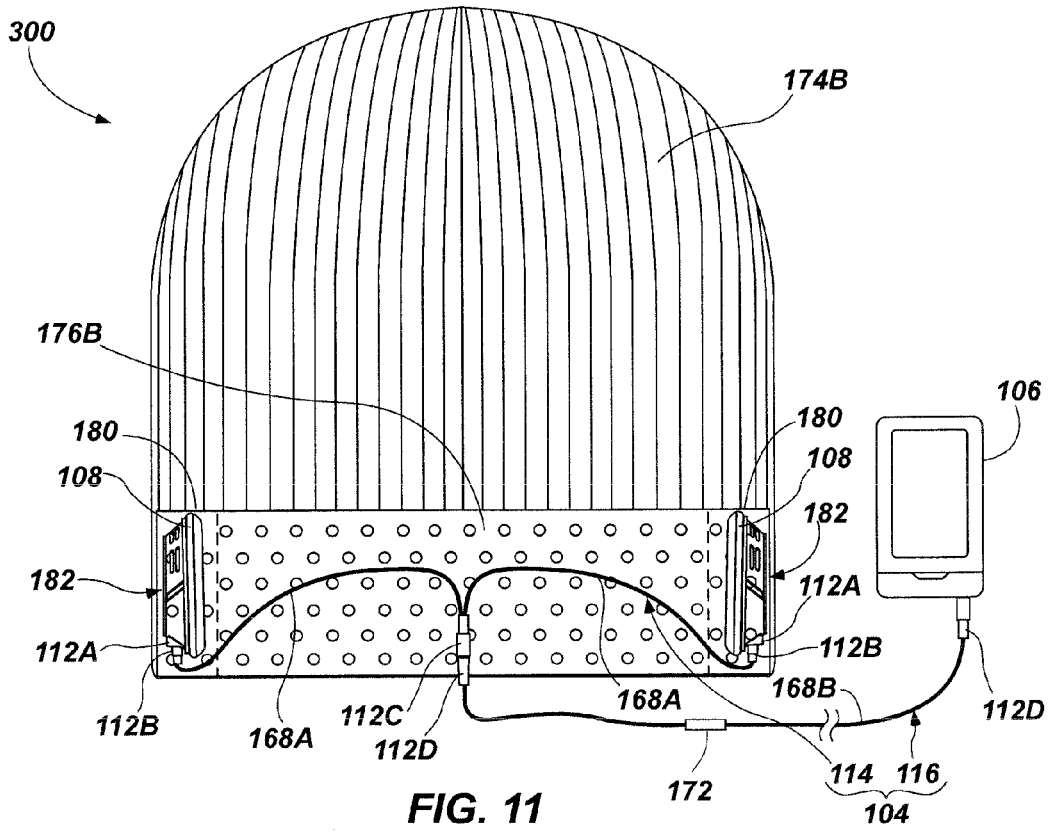

Referring specifically to FIG. 11, an interior rear of the skull cap is shown. The speaker assemblies 108 may be disposed in the mesh liner 176B on the first and second, opposing sides of the skull cap. For example, openings 180 may be formed in the mesh liner 176B and the speaker assemblies 108 may be slipped through the openings 180 into the mesh liner 176B. The speaker assemblies 108 may optionally be secured within the mesh liner 176B by closing the openings 180. The mesh liner 176B may include discrete compartments 182 for containing the speaker assemblies 108. The speaker assemblies 108 may be movable within the discrete compartments 182, and specific motions may enable a user to control the media player 106, as discussed previously with reference to FIG. 9. The speaker assemblies 108 may be secured within the mesh liner 176B in some embodiments. In alternative embodiments, the openings 180 may remain open, and gravity and friction may keep the speaker assemblies 108 in the mesh liner 176B.

The mesh liner 176B may include at least one aperture through which the wiring system 104, or at least portions thereof, may pass. For example, the first wiring assembly 114 may extend from the speaker assemblies 108 within the mesh liner 176B to a rear of the skull cap and connect to the second wiring assembly 116 within the mesh liner 176B at the rear of the skull cap. The second wiring assembly 116 may extend through an aperture at the rear of the skull cap out of the mesh liner 176B and the skull cap to a media player 106. Thus, the microphone assembly 172 (FIG. 1) may be located outside the mesh liner 176B and outside the user-wearable accessory 174B (i.e., outside the skull cap) because the microphone assembly 172 is connected to the wire 168B of the second wiring assembly 116, and not to the wires 168A of the first wiring assembly 114. In alternative embodiments, the wiring system 104 may extend from the speaker assemblies 108, through the openings 180 through which the speaker assemblies 108 were inserted, and out of the skull cap.

Figure 12:
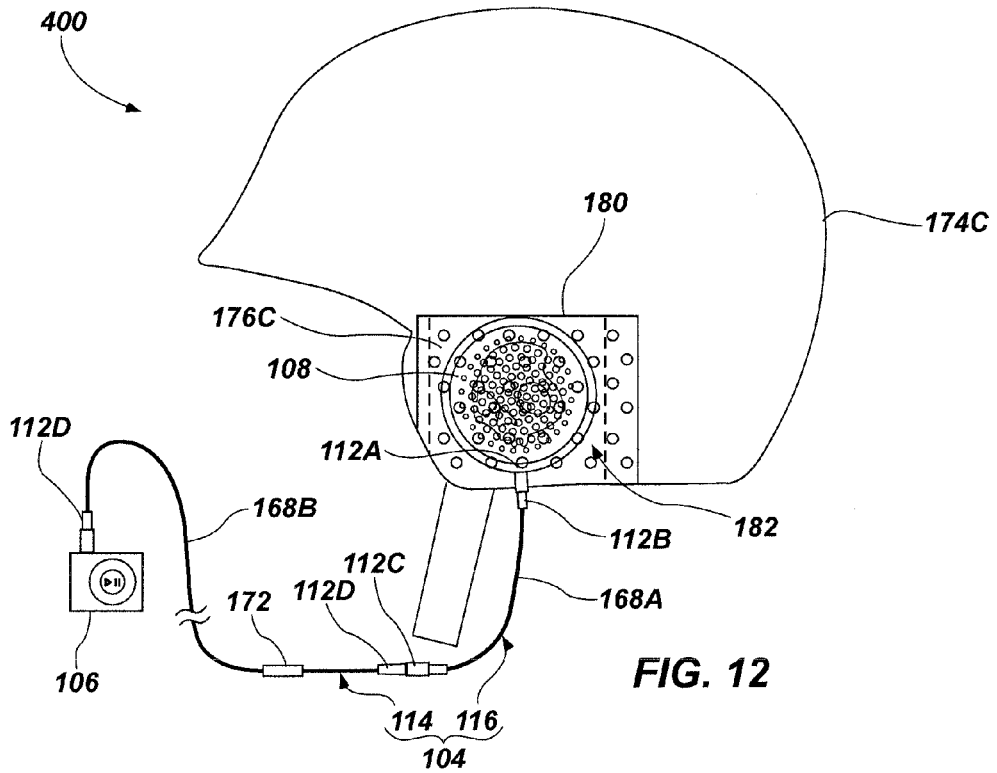

Referring specifically to FIG. 12, a side cross-sectional view of another embodiment of a modular audio system 400 is shown. Such a modular audio system 400 may include a user-wearable accessory 174C, at least one speaker assembly 108 (e.g., a pair of speaker assemblies 108), a wiring system 104, and a media player 106. The user-wearable accessory 174C may comprise, for example, a helmet. In this view, an interior side of the helmet is shown. The speaker assemblies 108 may be configured for placement in the helmet. For example, a mesh liner 176C configured to receive speaker assemblies 108 may be attached to an inner portion of the helmet. For example, the mesh liner 176C may be sewn, adhered, attached with hook and loop fasteners (e.g., VELCRO®), or attached with a zipper or zippers to the inner portion of the helmet. The mesh liner 176C may only be disposed on a first side and a second, opposing side of the helmet in some embodiments. In other embodiments, the mesh liner 176C may extend from a first side of the helmet, around a back of the helmet, to a second, opposing side of the helmet, or may extend entirely around the helmet. The first and second, opposing sides of the helmet lined by the mesh liner 176C may be located proximate a user's ears when the user is wearing the helmet.

The speaker assemblies 108 may be disposed in the mesh liner 176C on the first and second, opposing sides of the helmet (only one speaker assembly 108 on one side is shown in FIG. 12). For example, openings 180 may be formed in the mesh liner 176C and the speaker assemblies 108 may be slipped through the openings 180 into the mesh liner 176C. The speaker assemblies 108 may optionally be secured within the mesh liner 176C by closing the openings 180. The mesh liner 176C may form discrete compartments 182 for containing the speaker assemblies 108. The speaker assemblies 108 may be movable within the discrete compartments 182, and specific motions may enable a user to control the media player 106, as discussed previously with reference to FIG. 9. The speaker assemblies 108 may be secured within the mesh liner 176C in some embodiments. In alternative embodiments, the openings 180 may remain open, and gravity and friction may keep the speaker assemblies 108 in the mesh liner 176C.

The mesh liner 176C may include at least one aperture through which the wiring system 104, or at least portions thereof, may pass. For example, the first wiring assembly 114 may extend from the speaker assemblies 108, through the openings 180 through which the speaker assemblies 108 were inserted, and out of the helmet at the first and second, opposing sides of the helmet. In alternative embodiments, the wiring system 104 may extend from the speaker assemblies 108, through apertures in the mesh liner 176C, to a rear of the helmet where the wiring system 104 may exit the helmet. The first wiring assembly 114 may connect to the second wiring assembly 116 outside of the mesh liner 176C and outside of the helmet, and the second wiring assembly 116 may extend to a media player 106. Thus, the microphone assembly 172 may be located outside the mesh liner 176C and outside the user-wearable accessory 174C (i.e., outside the helmet).

Figure 13:
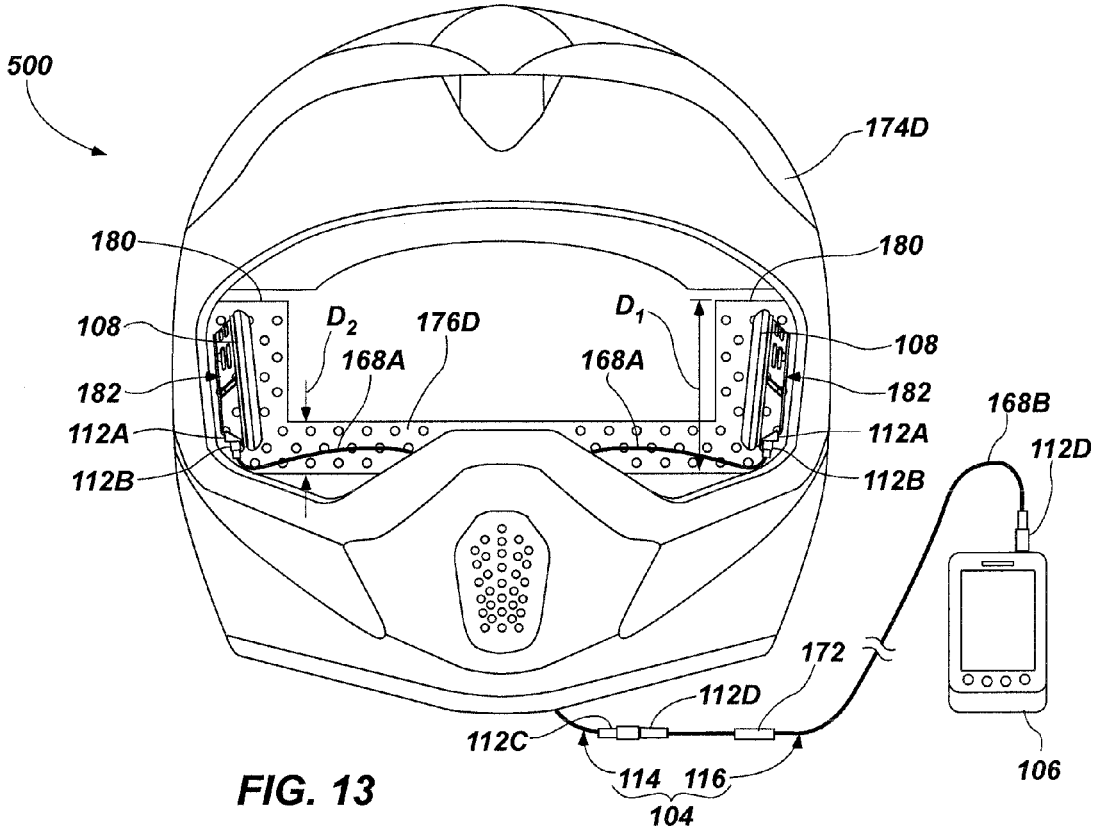

Referring specifically to FIG. 13, a front view of another embodiment of a modular audio system 500 is shown. Such a modular audio system 500 may include a user-wearable accessory 174D, at least one speaker assembly 108 (e.g., a pair of speaker assemblies 108), a wiring system 104, and a media player 106. The user-wearable accessory 174D may comprise, for example, a full-face helmet. The speaker assemblies 108 may be configured for placement in the full-face helmet. For example, a mesh liner 176D configured to receive speaker assemblies 108 may be attached to an inner portion of the full-face helmet. For example, the mesh liner 176D may be sewn, adhered, attached with hook and loop fasteners (e.g., VELCRO®), or attached with a zipper or zippers to the inner portion of the full-face helmet. The mesh liner 176D may extend from a first side of the full-face helmet, around a back of the full-face helmet, to a second, opposing side of the full-face helmet in some embodiments. In other embodiments, the mesh liner 176D may extend entirely around the interior of the full-face helmet, or may only be disposed on the first and second, opposing sides of the full-face helmet. The first and second, opposing sides of the full-face helmet lined by the mesh liner 176D may be located proximate a user's ears when the user is wearing the full-face helmet.

The speaker assemblies 108 may be disposed in the mesh liner 176D on the first and second, opposing sides of the full-face helmet. For example, openings 180 may be formed in the mesh liner 176D and the speaker assemblies 108 may be slipped through the openings 180 into the mesh liner 176D. The speaker assemblies 108 may optionally be secured within the mesh liner 176D by closing the openings 180. The mesh liner 176D may form discrete compartments 182 for containing the speaker assemblies 108. The discrete compartments 182 may have a greater depth $D_1$ than a depth $D_2$ of a remainder of the mesh liner 176D extending around the rear of the full-face helmet in which at least a portion of the first wiring assembly 114 may extend in some embodiments. In other embodiments, the mesh liner 176D may have a uniform depth. The speaker assemblies 108 may be movable within the discrete compartments 182, and specific motions may enable a user to control the media player 106, as discussed previously with reference to FIG. 9. The speaker assemblies 108 may be secured within the mesh liner 176D in some embodiments. In alternative embodiments, the openings 180 may remain open, and gravity and friction may keep the speaker assemblies 108 in the mesh liner 176D.

The mesh liner 176D may include at least one aperture through which the wiring system 104, or at least portions thereof, may pass. For example, the first wiring assembly 114 may extend from the speaker assemblies 108 within the mesh liner 176D to the rear of the full-face helmet, through an aperture in the mesh liner 176D, and out of the full-face helmet at the rear of the helmet. In alternative embodiments, the wiring system 104 may extend from the speaker assemblies 108, through the openings 180 through which the speaker assemblies 108 were inserted, and out of the full-face helmet. The first wiring assembly 114 may connect to the second wiring assembly 116 outside of the mesh liner 176D and outside of the full-face helmet, and the second wiring assembly 116 may extend to a media player 106. Thus, the microphone assembly 172 may be located outside the mesh liner 176D and outside the user-wearable accessory 174D (i.e., outside the full-face helmet) because the microphone assembly 172 is connected to the wire 168B of the second wiring assembly 116, and not to the wires 168A of the first wiring assembly 114.

Figure 14:
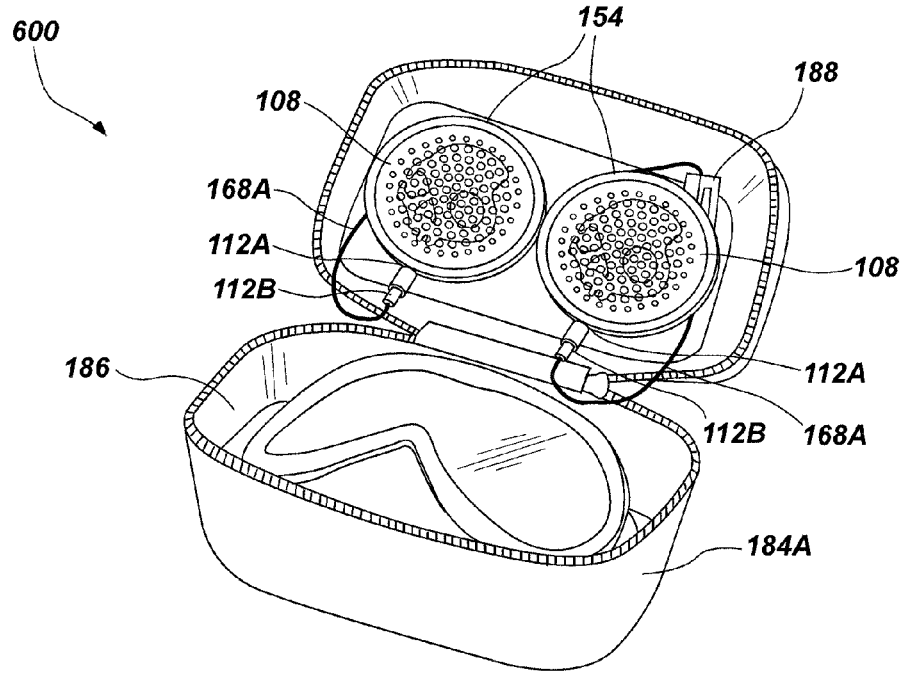
FIGS. 14 through 17 are views of modular audio systems including docks for receiving speaker assemblies.

FIGS. 14 through 17 are views of modular audio systems 100 including docks 184 for receiving speaker assemblies 108. Referring specifically to FIG. 14, a perspective view of a modular audio system 600 is shown. Such a modular audio system 600 includes a dock 184A and at least one speaker assembly 108 (e.g., a pair of speaker assemblies 108) connected to and supported by the dock 184A. The dock 184A may comprise, for example, a goggle case for holding ski, snowboard, motorcycle, or other types of outdoor goggles. The goggle case may include a first compartment 186 in which goggles may be disposed, and a second compartment 188 in which the speaker assemblies 108 may be disposed. Audio jacks 112B may be exposed within the second compartment 188, and the audio jacks 112B may be connected to the audio jacks 112A of the speaker assemblies 108. The audio jacks 112B may be structurally attached to the goggle case. Thus, the audio jacks 112A of the speaker assemblies 108 may be connected to the audio jacks 112B of the dock 184A simply by lowering the speaker assemblies 108 into place in the second compartment 188. The speaker assemblies 108 may be at least partially structurally supported by the audio jacks 112B. Wires 168A or other electrical connections may electrically connect the audio jacks 112B to a media player 106 (see FIG. 1), which may be, for example, connected to and supported by an outer portion of the goggle case defining the second compartment 188. The speaker assemblies 108 may optionally be at least partially supported by a portion of the goggle case defining the second compartment 188. For example, the goggle case may include attachment portions 154 similar to those described previously in connection with FIG. 6 to which the speaker assemblies 108 may be removably attached. The dock 184A may optionally include an electrical power source and an amplifier (not shown) to increase volume output of the speaker assemblies 108.

Figure 15:
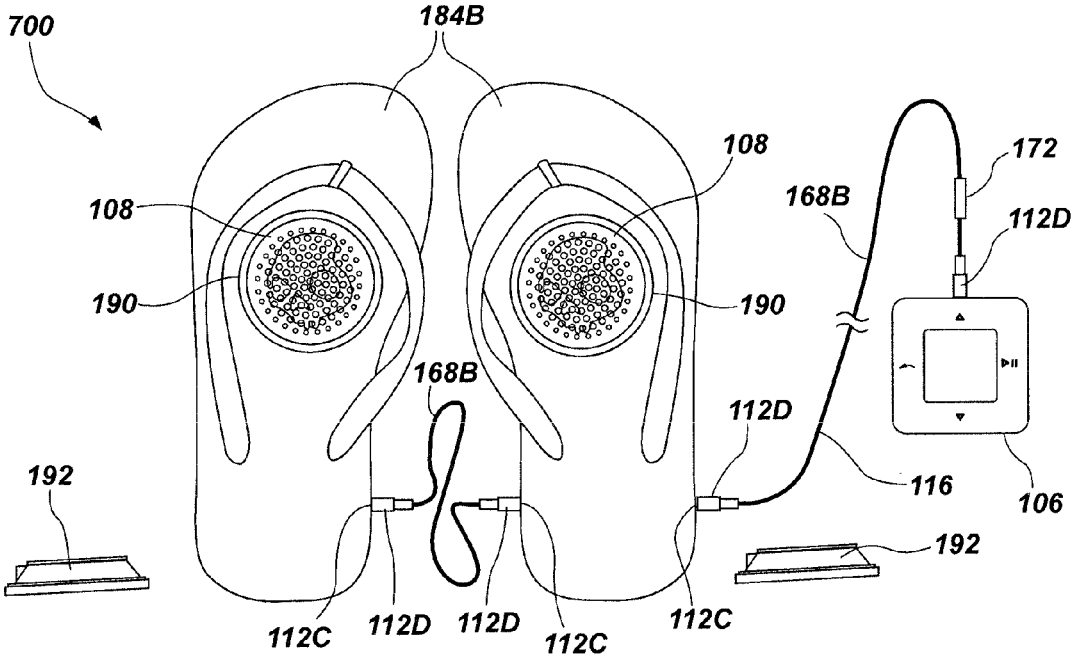

Referring specifically to FIG. 15, a perspective view of another embodiment of a modular audio system 700 is shown. Such a modular audio system 700 includes a dock 184B and at least one speaker assembly 108 (e.g., a pair of speaker assemblies 108) connected to and supported by the dock 184B. The dock 184B may comprise, for example, a pair of sandals. The sandals may each include recesses 190 in which the speaker assemblies 108 may be disposed. The sandals may include removable inserts 192 in the shape of speaker assemblies 108 to occupy the recesses 190 when a user wears the sandals. The recesses 190 may be configured in a manner similar to the attachment portions 154 described previously in connection with FIG. 6, and thus the speaker assemblies 108 may be removably attached to the sandals within the recesses 190. The speaker assemblies 108 may be connected to audio jacks and wiring (not shown) embedded within the sandals. A wire 168B having audio jacks 112D on the ends of the wire 168B may connect the sandals to one another. A second wiring assembly 116 may connect one of the sandals to a media player 106. The dock 184B may optionally include an electrical power source and an amplifier (not shown), such as, for example, embedded within the sandals, to increase volume output of the speaker assemblies 108.

Figure 16:
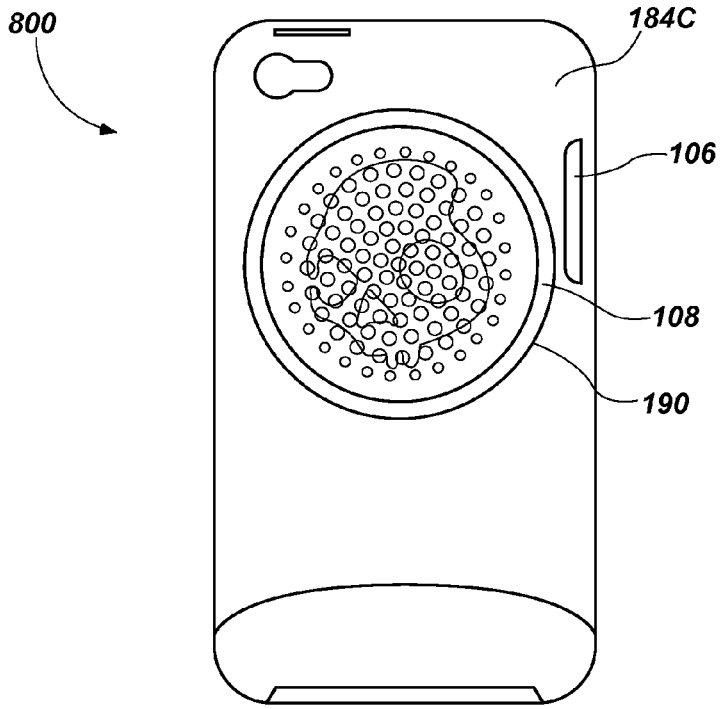

Referring specifically to FIG. 16, a perspective view of another embodiment of a modular audio system 800 is shown. Such a modular audio system 800 includes a dock 184C and at least one speaker assembly 108 (e.g., a single speaker assembly 108) connected to and supported by the dock 184C. The dock 184C may comprise, for example, a media player case (e.g., a phone case). The media player case may include a recess 190 in which the speaker assembly 108 may be disposed. The media player case may include a removable insert 192 (see FIG. 15) in the shape of a speaker assembly 108 to occupy the recess 190 when the speaker assembly 108 is not connected to the dock 184C. In some embodiments, the recesses 190 may be configured in a manner similar to the attachment portions 154 described previously in connection with FIG. 6, and thus the speaker assemblies 108 may be removably attached to the media player case within the recess 190. In alternative embodiments, the recesses 190 may be configured such that the speaker assembly 108 may simply be lowered into the recesses 190 to both structurally and electrically connect the speaker assembly 108 to the dock 184C. The speaker assembly 108 may be structurally and electrically connected to an audio jack (not shown) secured to the media player case, which may connect the speaker assembly 108 to the media player 106 contained within the media player case. The dock 184C may optionally include an electrical power source and an amplifier (not shown), such as, for example, embedded within the media player case, to increase volume output of the speaker assembly 108.

Figure 17:
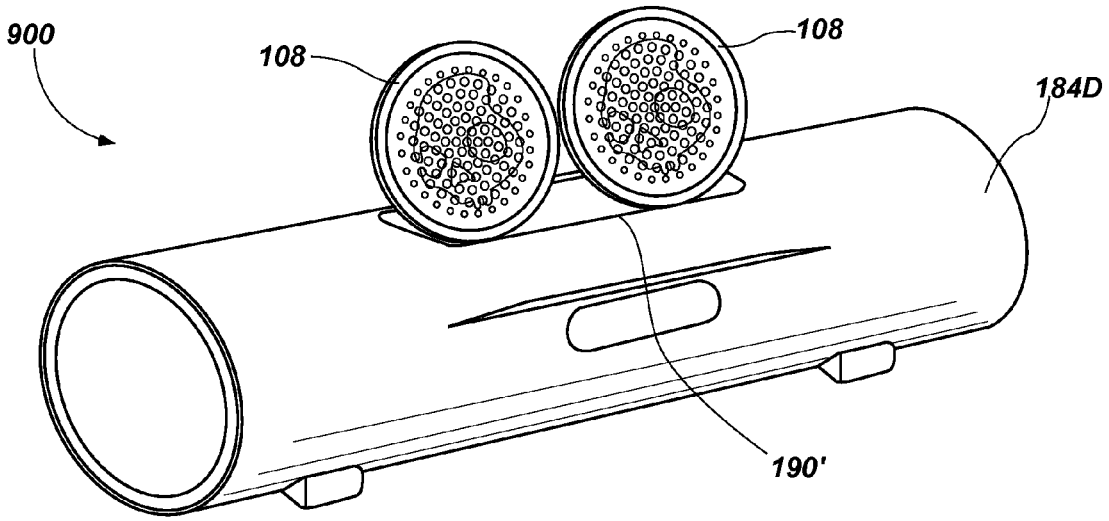

Referring specifically to FIG. 17, a perspective view of another embodiment of a modular audio system 900 is shown. Such a modular audio system 900 includes a dock 184D and at least one speaker assembly 108 (e.g., a pair of speaker assemblies 108) connected to and supported by the dock 184D. The dock 184D may comprise, for example, a distinct stand. The distinct stand may include a recess 190' in which the speaker assemblies 108 may be disposed. For example, the recess 190' may be configured such that the speaker assemblies 108 may simply be lowered into the recess 190' to both structurally and electrically connect the speaker assemblies 108 to the dock 184D. Thus, the speaker assemblies 108 may be quickly and easily swapped between accessories, such as, for example, docks 184, user-wearable accessories 174, and headbands 110 to adapt the speaker assemblies 108 for use in a variety of different environments. Each speaker assembly 108 may be electrically and structurally connected to an audio jack (not shown) secured to the dock 184D and exposed within the recess 190', which may connect each speaker assembly 108 to a media player 106 (see FIG. 1) attached to the distinct stand (e.g., using a wired connection) or wirelessly connected to the distinct stand. The audio jacks (not shown) may be physically integral to the dock 184D and may structurally support the speaker assemblies 108 in addition to providing direct electrical connection between the dock 184D and the speaker assemblies 108. Thus, a connection between the speaker assemblies 108 and the dock 184D may not be a wired connection, but a direct structural and electrical connection between the speaker assemblies 108 and the dock 184D. The dock 184D may optionally include an electrical power source and an amplifier (not shown), such as, for example, located within the distinct stand, to increase volume output of the speaker assembly 108.

While certain illustrative embodiments have been described in connection with the figures, those of ordinary skill in the art will recognize and appreciate that embodiments of the invention are not limited to those embodiments explicitly shown and described herein. Rather, many additions, deletions, and modifications to the embodiments described herein may be made without departing from the scope of embodiments of the invention as hereinafter claimed, including legal equivalents. In addition, features from one embodiment may be combined with features of another embodiment while still being encompassed within the scope of embodiments of the invention as contemplated by the inventor.

What is claimed is:

1. A modular audio system, comprising:

two speaker assemblies, each speaker assembly of the two speaker assemblies comprising:

a speaker;

an attachment structure comprising an at least substantially frustoconical surface and an elongated attachment feature extending along at least a portion of the at least substantially frustoconical surface; and an audio jack integral to each speaker assembly in electrical communication with the speaker;

a wiring system, comprising:

a first wiring assembly comprising two audio jacks configured to detachably connect to the audio jacks of the two speaker assemblies and two wires connected to the two audio jacks at first ends of the two wires; and a headband comprising a band configured for placement on a head of a user and two attachment portions at opposing ends of the band configured for removable attachment to the attachment structures of the two speaker assemblies, each attachment portion of the two attachment portions comprising:

a mating frustoconical surface complementary to the frustoconical surface of the attachment structure of a speaker assembly; and at least a second attachment feature on the mating frustoconical surface configured to engage with the at least a first attachment feature on the frustoconical surface of the attachment structure of a speaker assembly.

2. The modular audio system of claim 1, wherein the two speaker assemblies each comprise a housing, and the speaker and the audio jack are located within the housing.

3. The modular audio system of claim 1, wherein the wiring system further comprises:

another audio jack connected to the two wires of the first wiring assembly at second, opposing ends of the two wires; and a second wiring assembly comprising a first audio jack configured to connect to the another audio jack of the first wiring assembly, a wire connected to the first audio jack at a first end of the wire, a second audio jack connected to the wire at a second, opposing end of the wire and configured to connect to a media player, and a microphone assembly connected to the wire between the first and second audio jacks.

4. The modular audio system of claim 3, wherein the first and second audio jacks of the second wiring assembly comprise male audio jacks.

5. The modular audio system of claim 3, wherein the microphone assembly is positioned to be located proximate a mouth or vocal chords of a user when each speaker assembly is carried by a user-wearable accessory selected from the group consisting of a hood, a skull cap, and a helmet, when the two audio jacks of the first wiring assembly are connected to the audio jacks of the two speaker assemblies, and when the first audio jack of the second wiring assembly is connected to the another audio jack of the first wiring assembly.

6. A headphone assembly, comprising:

two speaker assemblies, each speaker assembly of the two speaker assemblies comprising:

a speaker;

an audio jack in electrical communication with the speaker; and an attachment structure configured for attachment to another structure, wherein the attachment structure of each speaker assembly of the two speaker assemblies comprises a frustoconical surface and at least a first attachment feature comprising at least one elongated feature on the frustoconical surface; and a headband comprising a band configured for placement over a head of a user and two attachment portions at opposing ends of the band configured for removable attachment to the attachment structures of the two speaker assemblies, each attachment portion of the two attachment portions comprising:

a mating frustoconical surface configured to abut against and conform to the frustoconical surface of the attachment structure of a speaker assembly; and at least a second attachment feature on the mating frustoconical surface configured to engage with the at least a first attachment feature on the frustoconical surface of the attachment structure of a speaker assembly.

7. The headphone assembly of claim 6, wherein the at least a first attachment feature extends entirely across the frustoconical surface.

8. The headphone assembly of claim 6, wherein central axes of the at least a first attachment feature are oriented at a first angle of inclination with respect to a central axis of each speaker assembly, and wherein the first angle of inclination is between 15° and 75°.

9. The headphone assembly of claim 6, wherein central axes of the first attachment features are oriented at a second angle of inclination with respect to a rear axis defined by a line perpendicularly intersecting a central axis of the speaker assembly and extending in a vertical direction when the speaker assembly is oriented with the audio jack facing downwardly and the second angle of inclination is between 15° and 75°.

10. The headphone assembly of claim 6, wherein the at least a first attachment feature comprises one of at least one slot extending into the frustoconical surface and at least one protrusion extending from the frustoconical surface, and wherein the at least a second attachment feature comprises the other of at least one slot extending into the mating frustoconical surface and at least one protrusion extending from the mating frustoconical surface.

* * * * *